United States Patent [19]

Crosby

[11] 4,364,547

[45] Dec. 21, 1982

[54] SEAT BASE ASSEMBLY

[75] Inventor: Lawton H. Crosby, Lake Bluff, Ill.

[73] Assignee: Morley Furniture Spring Corporation, Lake Bluff, Ill.

[21] Appl. No.: 194,900

[22] Filed: Oct. 7, 1980

Related U.S. Application Data

[60] Continuation-in-part of Ser. No. 45,625, Jun. 5, 1979, abandoned, which is a division of Ser. No. 865,966, Dec. 30, 1977, Pat. No. 4,157,173.

[51] Int. Cl.[3] ..... F16F 3/02

[52] U.S. Cl. ..... 267/110

[58] Field of Search ..... 267/99, 101, 110–112

[56] References Cited

U.S. PATENT DOCUMENTS 4,157,173 6/1979 Crosby ..... 267/110

*Primary Examiner*—Duane A. Reger

*Attorney, Agent, or Firm*—Hume, Clement, Brinks, Willian & Olds, Ltd.

[57] ABSTRACT

A family of improved seat base assemblies for furniture seats and automotive seats and the like. A cushion base means, which might comprise a plurality of sinuous spring bands, a wire mesh unit, or chord rubber webbing or the like, is mounted between the front, back, and side nails of the seat frame. Rail connecting means connect at least the back rail to the cushion base means. The rail connecting means provides vertically resilient support to the cushion base means which increases as the cushion base means moves downwardly under load. In one form of the invention rail connecting means connect a wire mesh unit to all four of the rails, around its entire periphery.

8 Claims, 29 Drawing Figures

FIG. 11
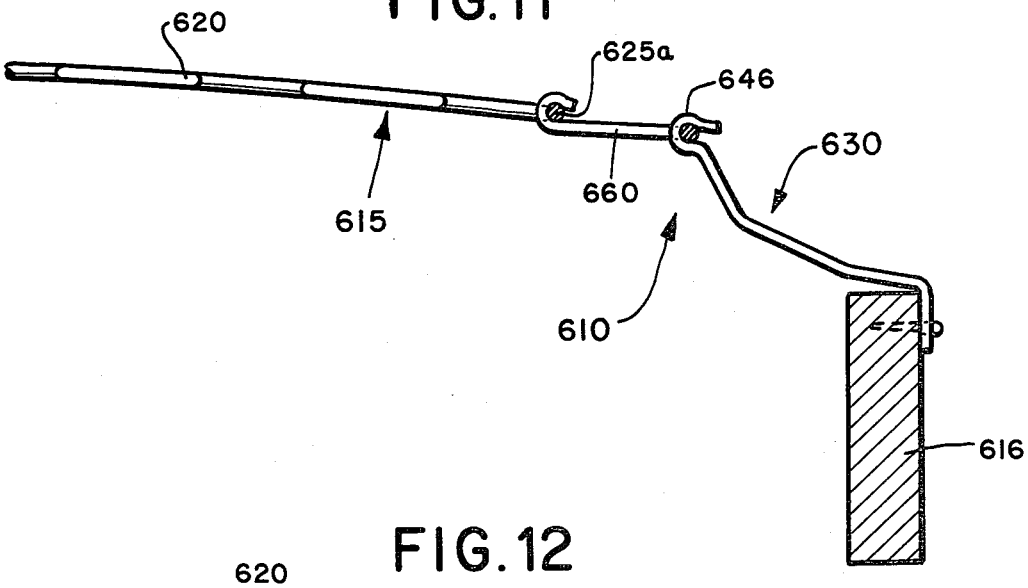
FIG. 12
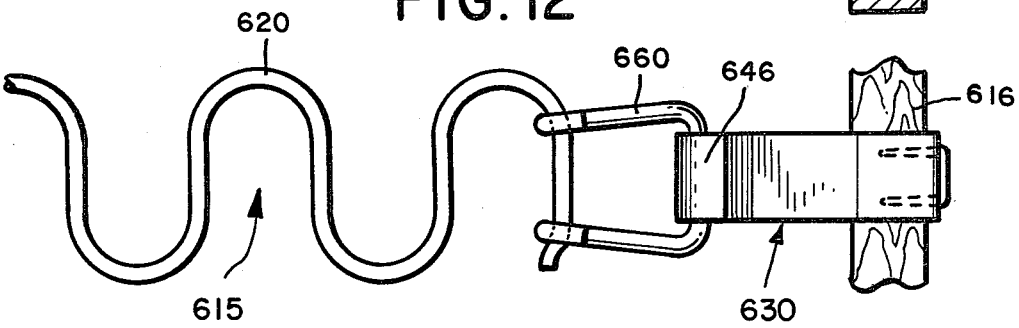
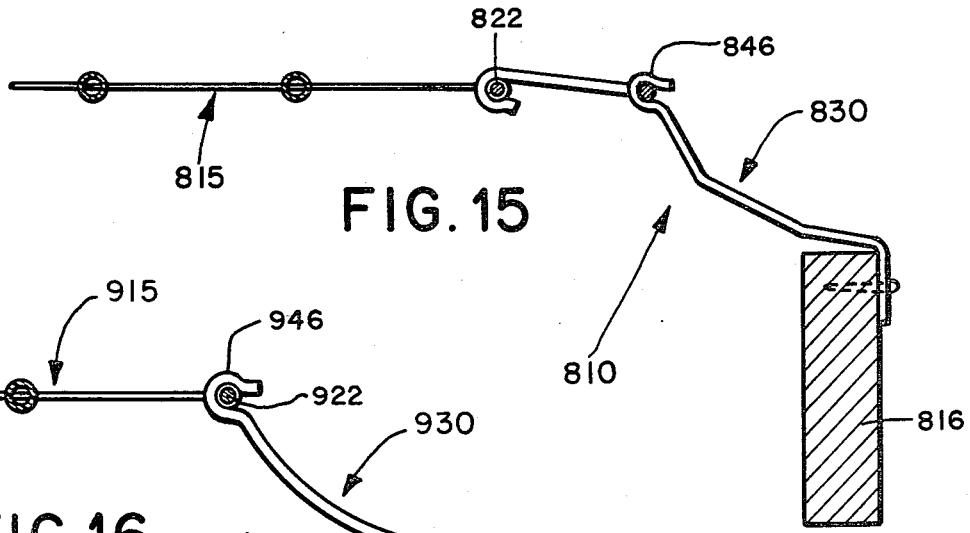
FIG. 15
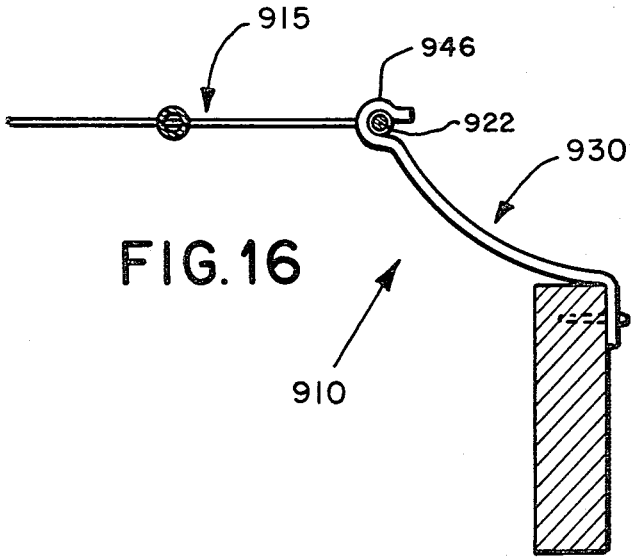
FIG. 16

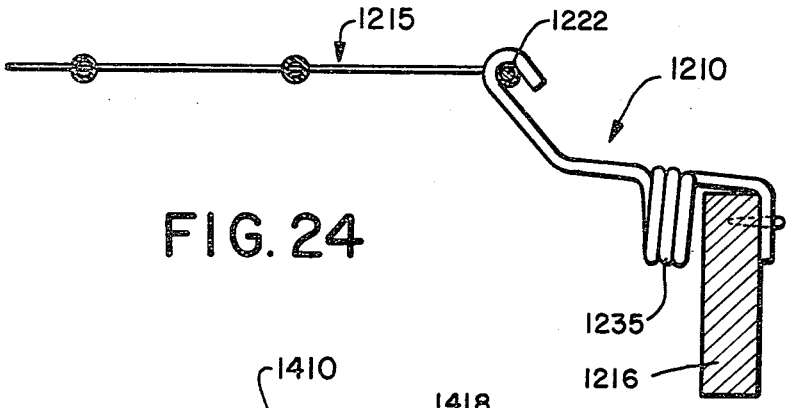
FIG. 24
FIG. 23
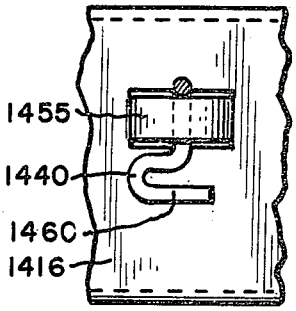
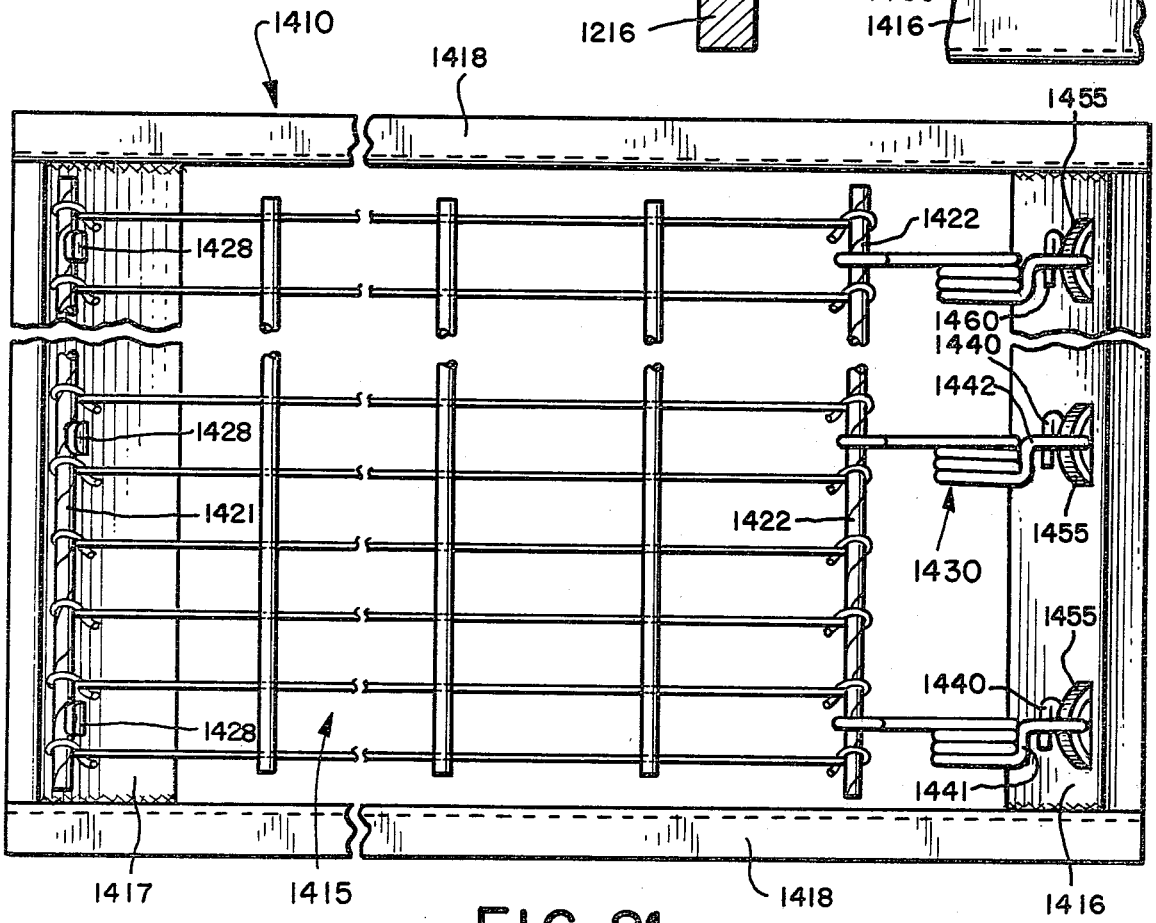
FIG. 21
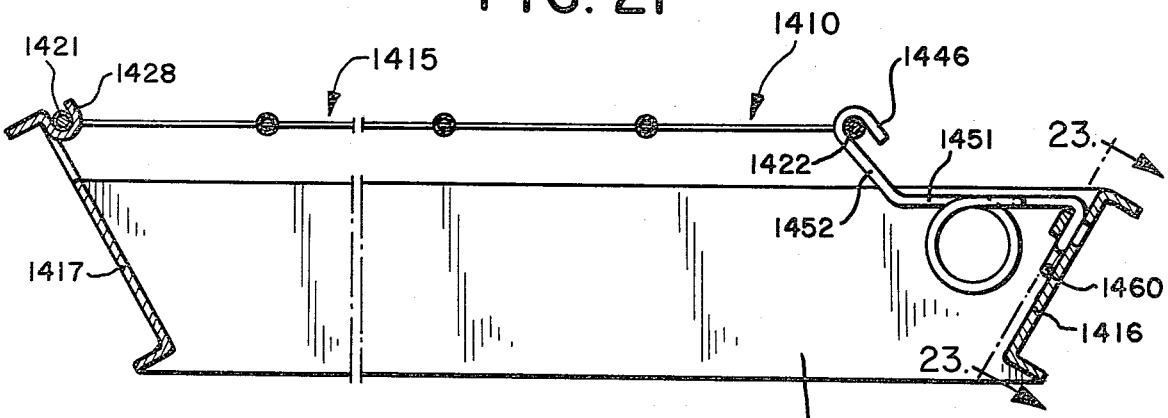
FIG. 22

SEAT BASE ASSEMBLY

This application is a continuation-in-part of application Ser. No. 06/045,625 filed June 5, 1979, now abandoned. The latter application is, in turn, a division of application Ser. No. 865,966, filed Dec. 30, 1977, now U.S. Pat. No. 4,157,173.

FIELD OF THE INVENTION

This invention is in the field of seat base assemblies. It relates to seat base assemblies for furniture and automobile seats and the like wherein the cushion base means employed are of the non-coil spring type. Such cushion bases include sinuous spring bands, wire mesh, chord-rubber webbing and flexible steel bands, for example. The present invention is particularly concerned with sinuous spring bands and wire mesh cushion bases.

BACKGROUND OF THE INVENTION

Over approximately the past fifteen years arced sinuous spring band torsioning devices such as disclosed in U.S. Pat. No. 3,210,064, No. 3,388,904, and No. 3,525,514, have met the industry's long sought need for deep-drop and uplift at the back rail and contributed in other ways to the luxury seat which evolved. As eleven (11) and twelve (12) gauge helical spring connectors became disproportionally more expensive during this period, however, such torsioning devices came to be used almost exclusively with connector links such as disclosed in U.S. Pat. No. 3,790,149. As such, the cushion base means depend solely upon kinetic energy stored in the arced sinuous, for example, to produce desired back rail deep-drop and uplift in upholstered furniture.

The past few years in the furniture field have seen a move toward the use of thicker cushions. The use of thicker materials such as poly-foam laminates has necessitated lowering seat frame heights significantly. This has necessitated the use of cushion bases with a flat or virtually flat profiles. Deflection and uplift capability are severly limited by these configurations and, thus, less than desirable comfort, if not discomfort, is produced in the seat base assembly.

Regardless of what kind of cushion base is employed, however, the industry is interested in a product wherein both soft, deep-drop and upward resilience of a strong dynamic nature is achieved in the seat base assembly at minimal cost. The results achieved to date have been less than satisfactory.

The problem is particularly troublesome with wire-mesh cushion base means. Wire-mesh cushion base means have very little deflection capability and no self-contained upward resilience. The resulting seat base assembly produces an unyielding and relatively uncomfortable seat.

An area where the same problem has existed, unimproved for many years, is the automobile seat industry. There the weight, size, and space limitations of automobile seating have denied manufactures the capability of using effective seat enhancement devices and constructions. This is particularly true in the newer, smaller automobiles.

In general, the use of a flat wire mesh grid, or flat steel bands, gives a flat final profile. The minimal deflection provided under load is largely in the center of the span. This is anatomically unsuited for the human body in seated relationship. Much greater deflection is needed and should be located at the rear end of the span. Equally important, dynamic buoyancy, support and uplift are needed at the rear of the span.

Attempts to solve this seating deficiency have resulted in the use of horizontally installed helicals, heavy rubber inserts, and pivoting wire linkages and the like, at the back of the span. They have failed to give desired comfort. The sideward horizontal pull, or expansion and contraction, afforded by helicals or heavy rubber band type inserts is mechanically grossly inefficient and ineffective in permitting downward initial drop and subsequent deep-drop on one hand, or in generating progressive, dynamic upward buoyancy, resilience, or lift on the other hand.

SUMMARY OF THE INVENTION

An object of the present invention is to provide an improved seat base assembly. Another object is to provide a seat base assembly which produces, for the first time, the three essentials of luxury seating: initial drop, deep-drop, and dynamic, progressive build-up of resilience or uplift under load, regardless of whether the cushion base comprises sinuous spring bands, a wire mesh grid, chord-rubber-webbing or flexible steel bands or the like. A further object is to provide a seat base assembly of the aforedescribed character effective in any type of seating arrangement; for example, in automobile seats, or in furniture pit groups where omni-directional seating is required, as well as in all other types of upholstered furniture.

The foregoing and other objects are realized in accord with the present invention by providing an improved seat base assembly incorporating vertically resilient rail connecting means at critical locations around the cushion base means. In standard configuration seat arrangements these vertically resilient connecting means are located only at the back rail. This is also true in automobile seat arrangements. In omni-directional seat arrangements such as pit groups and the like these rail connecting means surround the seat base means.

In standard configuration furniture seats and automobile seats, for example, the rail connecting means also support the back end of the cushion base means at a predetermined distance, preferably 3 to 4 CM, above the back rail. The top surface of the back rail is corresponding lower than the front rail. Accordingly, the cushion base means normally rides in perfectly horizontal relationship.

BRIEF DESCRIPTION OF THE DRAWINGS

The invention, including its construction and method of operation, together with additional objects and advantages thereof, is illustrated more or less diagramatically in the drawings, in which:

FIG. 11 is a view similar to FIG. 1 illustrating a seventh variation of the seat base assembly;

FIG. 12 is a top plan view of the assembly of FIG. 12;

FIG. 15 is a vertical sectional view through a portion of the back of a seat base assembly embodying features of a second variation of the FIG. 13, 14 seat base assembly;

FIG. 16 is a view similar to FIG. 15 illustrating a third variation of the FIG. 13, 14 seat base assembly;

FIG. 21 is a top plan view of a eighth variation of the FIG. 13, 14 seat base assembly embodying features of the present invention;

FIG. 22 is a vertical sectional view of the seat base assembly illustrated in FIG. 21;

FIG. 23 is an enlarged elevational view of a detail of the connector in the seat base assembly illustrated in FIGS. 21 and 22;

FIG. 24 is a view similar to FIG. 15 illustrating a sixth variation of the FIG. 13, 14 seat base assembly;

DESCRIPTION OF THE PREFERRED EMBODIMENTS

Figure 1:
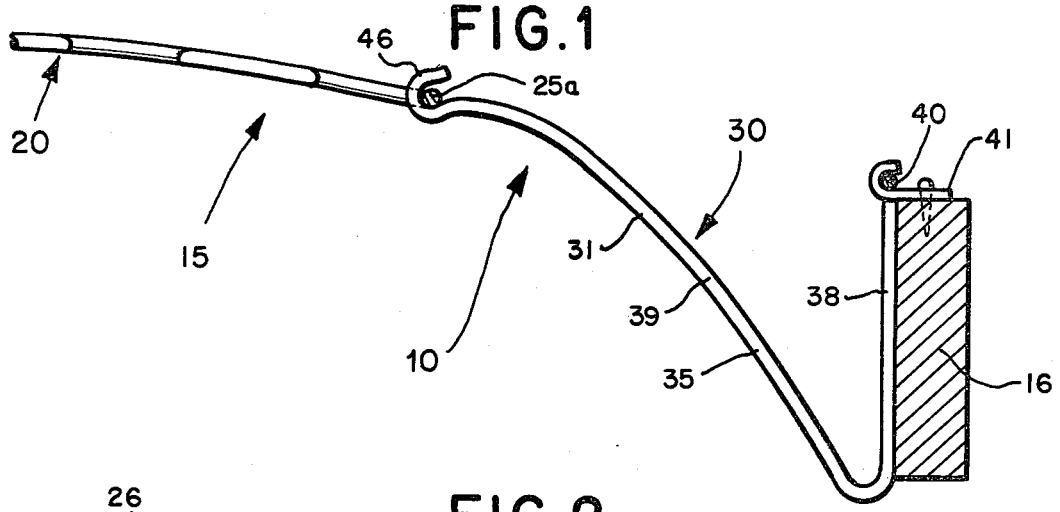
FIG. 1 is a vertical sectional view through a portion of the back of a furniture seat base assembly, illustrating a first form-first variation of the present invention.
Figure 2:
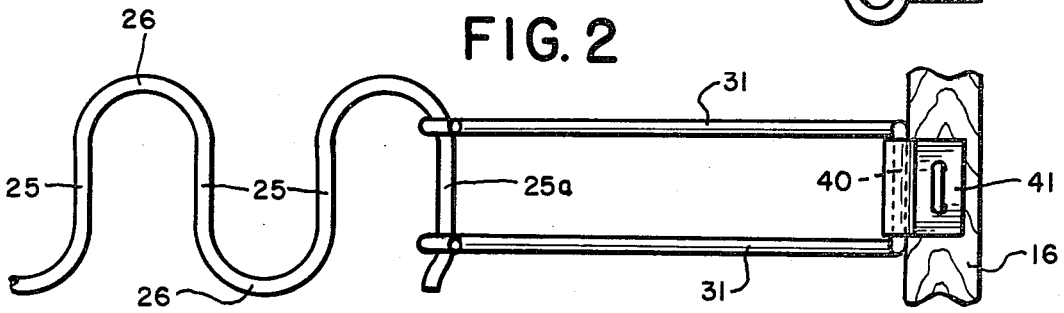
FIG. 2 is a top plan view of the assembly of FIG. 1.

Referring now to the drawings, and particularly to FIGS. 1 and 2, a portion of the back end of a furniture seat base assembly embodying a first form-first variation of the present invention is illustrated generally at 10. The seat base assembly 10 comprises a cushion base means in the form of a plurality of sinuous spring band assemblies 15, only of which is shown, extending in parallel relationship between the front rail (not shown) and the back rail 16 of a base frame. In the present illustration each spring band assembly 15 includes a normally arced sinuous spring band 20 of standard loop size; i.e., a twenty three millimeter (23 mm) interval between linear segments 25 of the band. The linear segments 25 are connected by semi-circular segments 26 of the band in a conventional manner. Each band 20 is connected to the back frame rail 16 by a rail connector 30. A conventional HDS clip connects the front end of the band 20 to the top of the front rail.

The rail connector 30 uses a cantilever principal to provide dynamic uplift to the band 20 at the back rail 16. The rail connector 30 is fabricated of spring steel wire of relatively heavy gauge; i.e., eight (8) gauge or heavier and includes a pair of identical connector arms 31 extending parallel to each other between the rail 16 and the band 20, as seen in FIG. 2.

Each connector arm 31 includes a generally Vee shaped body 35 made up of a rail attachment leg 38 and a spring attachment leg 39. The legs 38 are vertically oriented and preferably ten centimeters (10 cm) long. The legs 38 are joined at their upper ends by a base leg 40 which seats in a conventional HDS clip 41 stapled to the top of the rail 16.

Curving upwardly and inwardly from the lower end of each rail attachment leg 38 is the corresponding spring attachment leg 39. The spring attachment legs 39 are approximately fifteen centimeters (15 cm) long.

Formed on the free ends of the legs 39 are attachment hooks 46. The hooks 46 open upwardly and outwardly to receive and seat on the ultimate linear segment 25*a* of the band 20.

In operation, the legs 38 are braced against the rail 16 with the spring attachment legs 39 extending inwardly and upwardly therefrom to the hooks 46. In unloaded position the hooks 46 are disposed slightly above the level of the EKS clip 41. The connector 30 is effective to dynamically urge the spring band 20 upwardly at its back end when a subject is seated. At the same time longitudinal, resilient expansion-contraction takes place in the connector 30, enhancing seat base softness.

Figure 3:
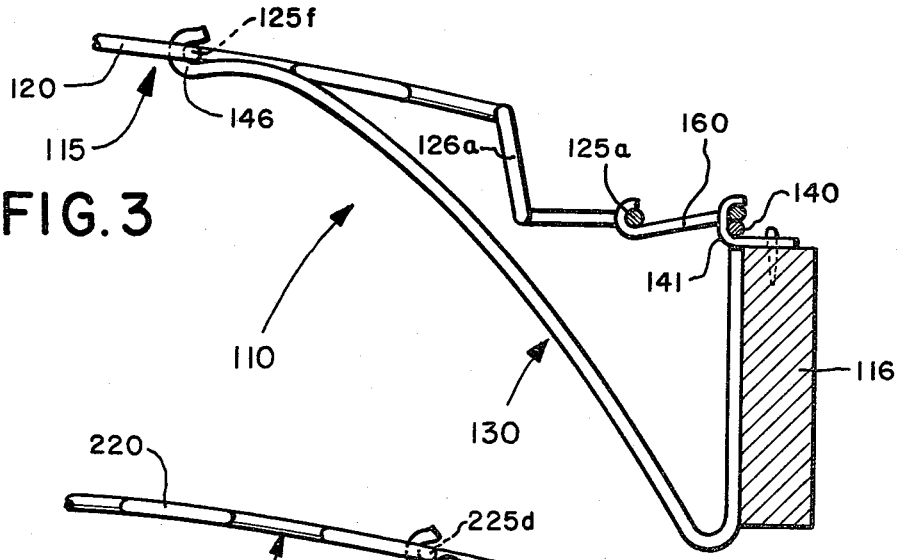
FIG. 3 is a view, similar to FIG. 1, illustrating a second variation of the seat base assembly.

FIG. 3 illustrates a portion of a seat base assembly 110 embodying a first form-second variation of the invention. The seat base assembly 110 includes a sinuous spring band assembly 115 which incorporates a connector 130 substantially identical to the connector 30 hereinbefore discussed. In the spring band assembly 115 the connector hooks 146 are seated on a linear segment 125*f* of the band 120 which is sixth from the end of the band; i.e., the ultimate linear segment 125*a*. The linear segment 125*a* is connected to the rail by a swing anchor 160 such as illustrated in FIG. 1 of U.S. Pat. No. 3,790,149. The base of the anchor 160 is seated, together with the base leg 140 of the connector 130, in a conventional HDS clip 141 stapled to the top of the rail 116.

The spring band 120, immediately inward of its ultimate linear segment 125*a*, at the penultimate linear segment, is bent upwardly for the length of one semi circular band segment 126*a* and then bent back into the normal arc of the band. This creates a torsion-inducing moment arm configuration in the end of the band, as illustrated at FIG. 12 in U.S. Pat. No. 3,525,514.

In operation of each spring band assembly 115 in a seat base assembly 110 the connector 130 performs the same function previously described with relation to the connector 30. However, its dynamic uplift is effected inwardly of the band end. This uplift, coupled with the torsion-inducing band 120 configuration, and the articulated connection provided by the swing anchor 160, produces a highly sophisticated and luxurious seat base assembly 10.

Figure 4:
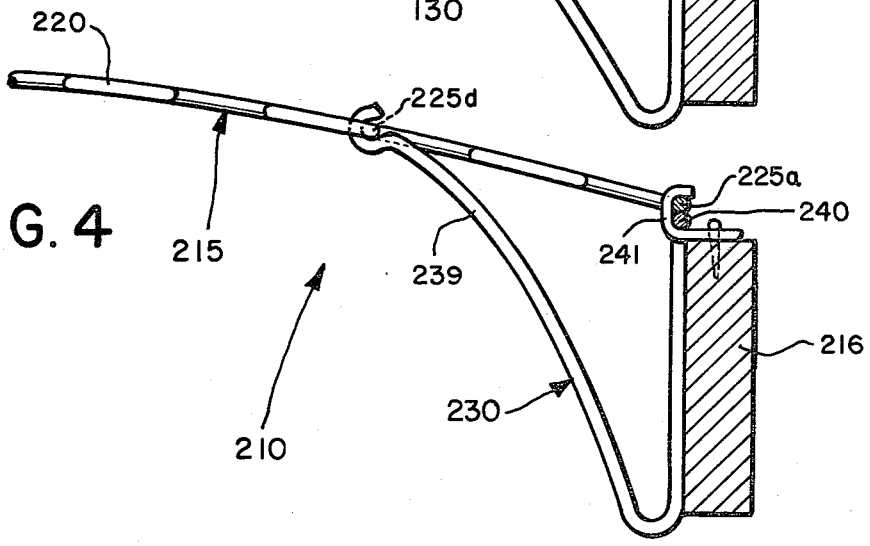
FIG. 4 is a view similar to FIG. 1 illustrating a third variation of the seat base assembly.

FIG. 4 illustrates a portion of a seat base assembly 210 embodying a first form-third variation of the invention. The seat base assembly 210 includes a sinuous spring band assembly 215 which incorporates a connector 230 substantially identical to the connector 30 hereinbefore discussed. In the assembly 215 the sinuous band 220 is de-arced, however; i.e., it has very little arc to it and thus has very little inherent upward resilience. In this assembly the connector 230 preloads the band 220 upwardly at the fourth linear segment 225*d* from the ultimate linear segment 225*a*.

The ultimate linear segment 225*a* is seated in the HDS clip 241 on the rail 216, together with the base leg 240 of the connector 230. The connector leg 239 thus preloads the band 220 upwardly with the seat base assembly 210 in its relaxed state. As a subject is seated and rises the connector provides a dynamic uplift which would otherwise not be present.

Figure 5:
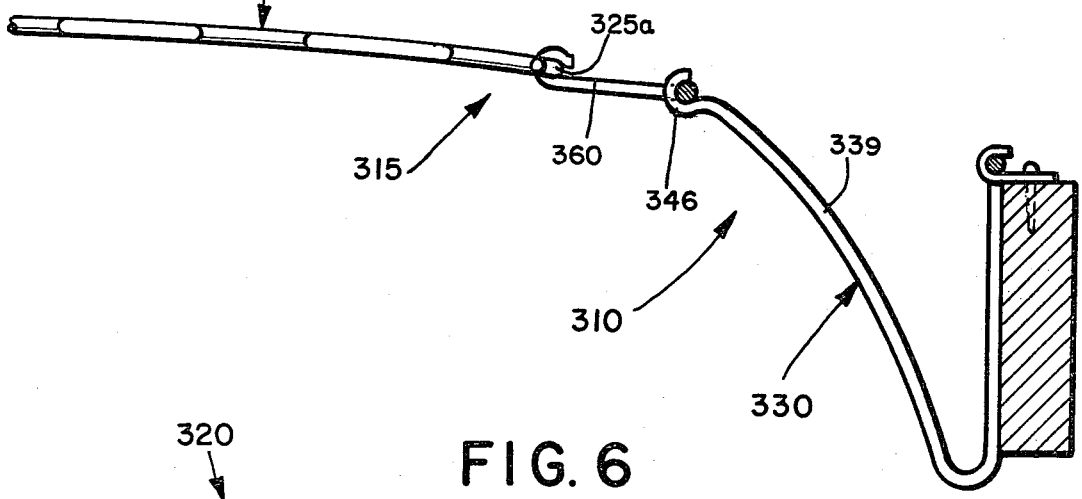
FIG. 5 is a view, similar to FIG. 1, illustrating a fourth variation of the seat base assembly.
Figure 6:
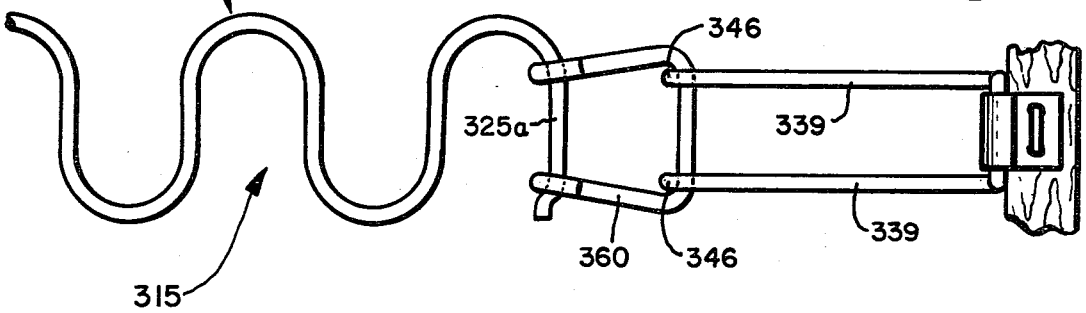
FIG. 6 is a top plan view of the assembly of FIG. 5.

FIGS. 5 and 6 illustrate a portion of a seat base assembly 310 embodying a first form-fourth variation of the invention. The seat base assembly 310 includes a sinuous spring band assembly 315 which incorporates a connector 330 substantially identical to the connector 30 hereinbefore discussed.

In fact, the spring band assembly 315 is identical to the spring band assembly 15 hereinbefore described, except for the provision of an additional element; i.e., a swing anchor 360 disposed between the ultimate linear segment 325*a* of the sinuous spring band 320 and the attachment hooks 346 on the upper ends of the spring attachment legs 339 in the rail connector 330. The swing anchor 360 is, once again, identical to that illustrated in FIG. 1 of U.S. Pat. No. 3,790,149.

This construction affords an additional amount of initial softness in the back of the spring band assembly 315 as a subject is seated. This initial softness results from the fact that as a subject is seated, even before the cantilever construction connector 330 begins to resiliantly bend downwardly, the swing anchor 360 pivots downwardly about its base leg seated in the hooks 346 of the connector 330, "initially" dropping the back end of the band 320. Although slightly more expensive than the assembly 15 hereinbefore discussed as a result of the use of the swing anchor 360, it does provide an additional element of luxury in the seating characteristics of the seat base 310.

Figure 7:
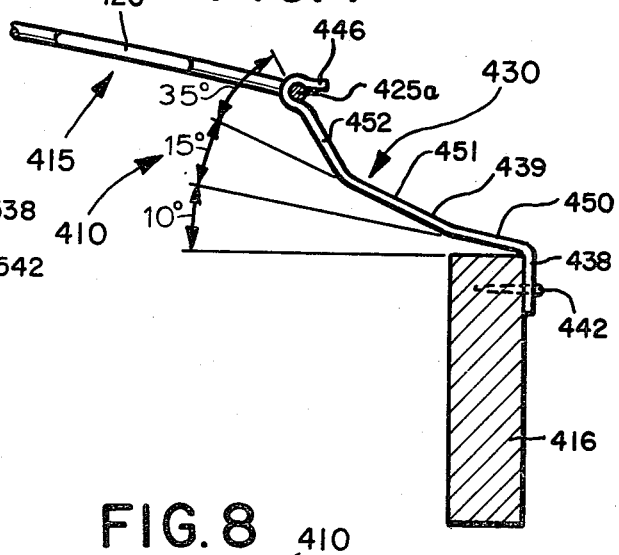
FIG. 7 is a view, similar to FIG. 1, illustrating a fifth variation of the seat base assembly.
Figure 8:
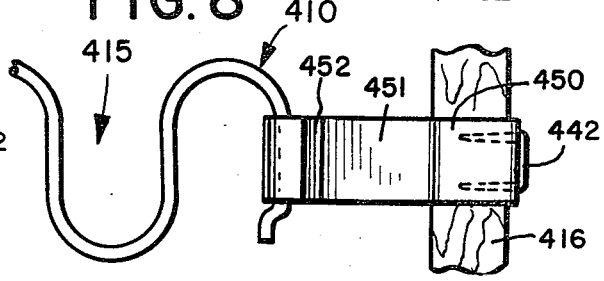
FIG. 8 is a top plan view of the assembly of FIG. 7.

FIGS. 7 and 8 illustrate a portion of a seat base assembly 410 embodying a first form-fifth variation of the invention. The seat base assembly 410 includes a sinuous spring band assembly 415 which incorporates a connector 430 quite distinct in construction and only generally similar in operation to the connector 30 hereinbefore discussed.

The connector 430 comprises an irregularly shaped strip of tempered spring steel formed to a thickness of approximately two (2) millimeters and a width of approximately two (2) centimeters. The connector strip 430 includes a rail attachment leg 438 and a spring attachment leg 439.

The rail attachment leg 438 is a vertical segment of the strip which is designed to be fastened to the back rail 416 of the furniture frame. To this end, the leg 438 is suitably apertured to permit a staple 442 to be driven through it to fasten the connector 430 firmly to the outside surface of the back rail 416.

The spring attachment leg 439 is divided into three angularly displaced segments; an outer segment 450 immediately adjacent to leg 438, an intermediate segment 451 inclined inwardly and upwardly from the segment 450, and an inner segment 452 inclined upwardly, in turn, from the segment 451. The outer segment 450 is approximately two (2) centimeters long and inclined upwardly at a ten degree (10°) angle to the horizontal and to the top surface of the rail 416. The intermediate segment 451 is approximately three (3) centimeters long and is inclined upwardly at an angle of fifteen degrees (15°) from the outer segment 450 or twenty five degrees (25°) from the horizontal. The inner segment 452 is approximately two (2) centimeters long and is inclined upwardly at an angle of thirty five (35°) from the intermediate segment 451 or sixty degrees (60°) from the horizontal.

At the free end of the spring attachment leg 439 an attachment hook 446 is formed. The attachment hook 446 faces outwardly toward the rail 416 and the ultimate linear segment 425*a* of a conventional sinuous spring band 420 is seated in it. The sinuous spring band 420 is, in a manner similar to the variations of the invention hereinbefore discussed and illustrated in FIGS. 1–6, connected to the top of the front rail of the furniture seat base by any conventional such as and HDS or EKS clip (not shown).

In operation, the connector 430 reacts to a subject being seated on the cushion (not shown) covering the seat base assembly 410 by initially offering minimal resistance to load. When the leg segment 450 engages the rail 416 top surface, however, resistance to downward movement under load is increased substantially. Further downward movement of the band 420 under load is met by further increasing resistance caused by two factors. First, the increased bending of the steel strip forming the spring attachment leg 439 results in increased stress developing in the strip and, thus, increased resistance to further bending. Second, the angular relationship of the strip segments 452 and 451 to each other and to the rail 416 when the segment 450 has bottomed on the rail top develops a further increasing resistance to downward deflection according to the invention.

Figure 9:
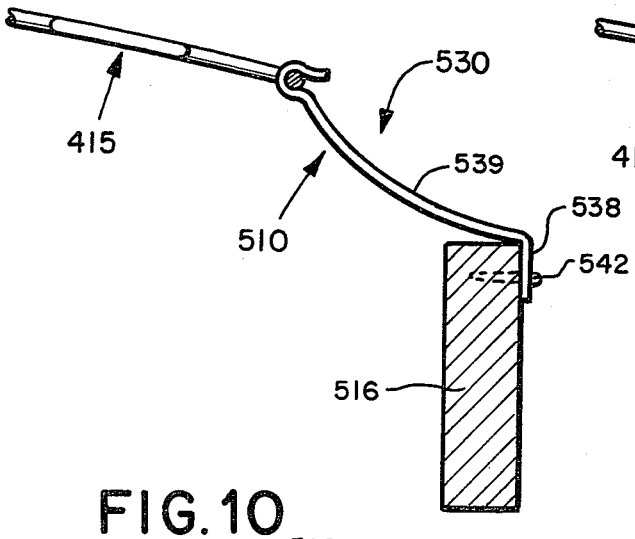
FIG. 9 is a view similar to FIG. 1 illustrating a sixth variation of the seat base assembly.
Figure 10:
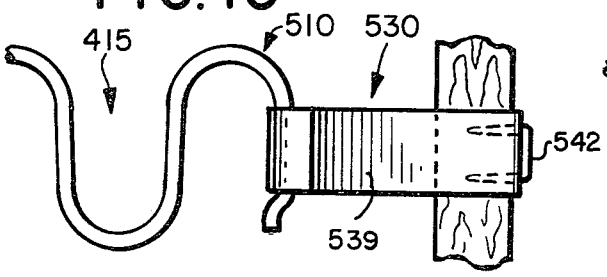
FIG. 10 is a top plan view of the assembly of FIG. 9.

FIGS. 9 and 10 illustrate a portion of a seat base assembly 510 embodying a first form-sixth variation of the invention. The seat base assembly 510 includes a sinuous spring band assembly 515 which incorporates a connector 530 similar in construction and operation to the connector 430 discussed above.

The connector 530 comprises a strip of tempered spring steel formed to a thickness of approximately two (2) millimeters, and a width of approximately two (2) centimeters. The connector strip 530, like the connector strip 430, includes a rail attachment leg 538 and a spring attachment leg 539.

The rail attachment leg 538 is a vertical segment of the strip which is fastened to the back rail 516 of the furniture frame by a staple 542. The spring attachment leg 439 is approximately five (5) centimeters long and is curved upwardly in an arc on a radius of approximately five (5) centimeters. It will thus be seen that the connector 530 approximates the configuration of the connector 430 but follows a continuous arc rather than being comprised of a series of angularly related segments.

FIGS. 11 and 12 illustrate a portion of a seat base assembly 610 embodying a first form-seventh variation of the invention. The seat base assembly 610 includes a sinuous spring band assembly 615 which incorporates a connector 630 identical in construction and operation to the connector 430 discussed above. Corresponding reference numerals, plus two hundred (200) digits, are thus used to identified corresponding components of the seat base assembly 610.

The assembly 610 differs from the assembly 410 in that the connector 630 is connected to the ultimate linear segment 625*a* of the sinuous spring band 620 by a swing anchor 660. As seen in FIG. 12, the swing anchor 660 is identical to the swing anchor 360 illustrated in FIGS. 5 and 6 and, as such, has its base leg seated in the open mouth 646 of the connector 630.

Figure 13:
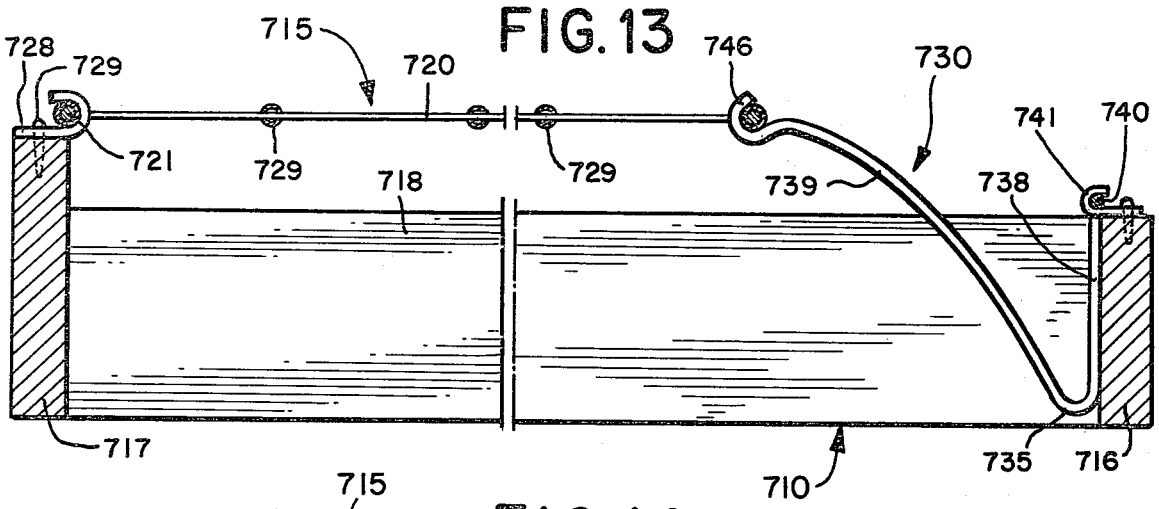
FIG. 13 is a vertical sectional view through a seat base assembly embodying features a second form-first variation of the present invention.
Figure 14:
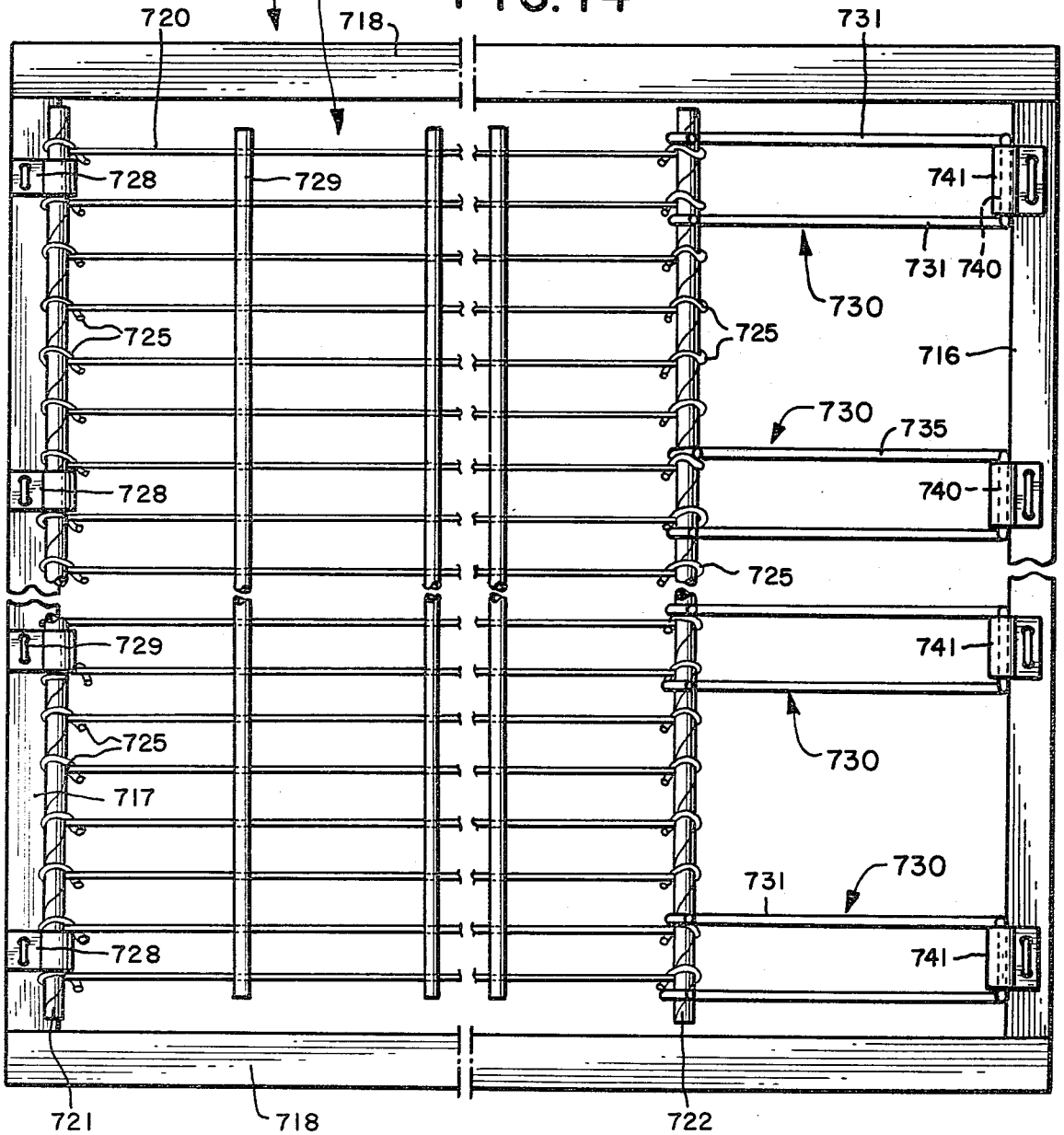
FIG. 14 is a top plan view of the seat base assembly illustrated in FIG. 13.

Turning now to FIGS. 13 and 14, a second form-first variations of a seat base assembly embodying features of the invention is illustrated generally at 710. The seat base assembly 710 comprises cushion base means in the form of a wire mesh unit 715 mounted between the back rail 716 and the front rail 717 of a base frame. The rails 716 and 717 are connected by two side rails 718.

The wire mesh unit 715 is conventionally constructed from a plurality of longitudinally extending (front to back) steel wires 720 formed of high strength, sixteen (16) gauge wire stock fastened between a front border wire 721 and a back border wire 722. The steel wires 720 are spaced at two and one-half centimeter (2.5 cm) intervals transversely of the seat base assembly 710. In the present example which is a seat base for a standard chair seat, twenty four (24) such wires 720 are utilized.

The wires 720 are, at their opposite ends, wrapped around the corresponding front border wire 721 and back border wire 722 and back upon themselves, as at 725, to firmly anchor the wires to the paper covered border wires 721 and 722. Spaced equidistantly along the length of the steel wire 720, and extending transversely thereof, are spacer tubes 727. The spacer tubes 727 are conventionally fabricated of small diameter plastic tubing and are perforated transversely of their longitudinally axes so as to permit each of the wires 720 to pass transversely through them in the manner illustrated.

The wire mesh unit 715 thus constitutes a rectangular wire grid with the steel wires 720 extending longitudinally and the front border wire 721, the back border wire 722, and the spacers 727 extending transversely of the seat base assembly 710. The wire mesh unit 715 is mounted between the back rail 716 and the front rail 717 of the seat base frame in a manner which will now be discussed.

At the front rail 717 the wire mesh unit 715 is pivotally connected to the rail on the axis of the front border wire 71 by a plurality of conventional EKS clips 728. The EKS clips are fastened to the top of the front rail 717 by corresponding staples 729. The front border wire 721 seats in the EKS clips so that its pivot axis is in vertical alignment with the inner surface of the front rail 717, as best seen in FIG. 13.

As illustrated in FIG. 14, the transverse dimension of the wire mesh unit 715 is such that the border wires 721 and 722 extend substantially the entire distance between the side rails 718. The outermost steel wires 720 are spaced but a short distance, approximately three centimeters (3 cm) in the present illustration, from the side rails.

The longitudinal dimension of the wire unit 715, between the front border wire 721 and the back border 722, is such that it extends approximately ninety percent (90%) of the distance between the front rail 717 and the back 716. Thus, in a conventional seat frame having front to back dimensions of sixty centimeters (60 cm), the wire mesh unit 715 would have a longitudinal dimension of fifty-four centimeters (54 cm).

The back end of the wire mesh unit 715 is connected to the back rail 716 of the seat frame by a series of four (4) rail connectors 730 which are substantially identical to the connector 30 illustrated in FIGS. 1 and 2. The rail connectors 730 are fabricated of spring steel wire, preferably eight (8) guage. Each comprises a pair of identical connector arms 731 extending parallel to each other between the back rail 716 and the back border wire 722 of the wire mesh unit 715.

Each connector arm 731 includes a generally Vee shaped body 735 made up of a rail attachment leg 738 and a spring attachment leg 739. The legs 738 are vertically oriented and preferably ten centimeters (10 cm) long. The legs 738 are joined at their upper end by a base leg 740 which seats in a conventional EKS clip 741 stapled to the top of the rail 716.

Curing upwardly and inwardly from the lower end of each rail attachment leg 738 is the corresponding spring attachment leg 739. The spring attachment legs 739 are approximately fifteen centimeters (15 cm) long.

Formed on the free ends of the legs 739 are attachment hooks 746. The hooks 746 open upwardly and outwardly to receive and seat on the back border wire 722 of the wire mesh unit 715.

The top of the back rail 716 is positioned at a vertical distance of four centimeters (4 cm) below the top of the front rail 717. The rail connector 730 is constructed in such a manner that the attachment hooks 746 extend four centimeters (4 cm) above the top of the rail 716 with the connectors mounted and connected to the back of the wire mesh unit 715 in a manner which has just been discussed. In this relationship the wire mesh unit 715 is horizontally oriented in the manner illustrated in FIG. 13. As such, it supports the cushion in horizontal relationship.

In operation, the legs 738 are braced against the rail 716 with the spring attachment legs 739 extending inwardly and upwardly therefrom to the hooks 746. The connector 730 is effective to dynamically urge the wire mesh unit 715 upwardly at its back end when a subject is seated. At the same time, longitudinal, resilient expansion-contraction takes place in the connector 730, enhancing seat base softness.

FIGS. 15–20, 24 and 25, illustrate second through seventh variations of the second form of seat base assembly 710 illustrated in FIGS. 13 and 14. The second variation is seen (partially) at 810 in FIG. 15, the third variation at 910 in FIG. 16, the fourth variation at 1010 in FIGS. 17 and 18, the fifth variation at 1110 in FIGS. 19 and 20, the sixth variation at 1210 in FIG. 24, and the seventh variation at 1310 in FIG. 25.

The second through seventh variations of the seat base assembly 710 differ primarily in the form of the back rail connector (730 in FIGS. 13 and 14). The wire mesh units 815–1315, and the manner in which these wire mesh units are connected to the front rails (not shown) in each of these variations, are identical to those described in the seat base assembly 710. Accordingly, where illustrated, corresponding components bear corresponding reference numerals with the exception that the initial digit in the three-digit reference numeral differentiates between the variations.

The second variation of seat base assembly seen at 810 in FIG. 15 employs a rail connector 830 identical to the rail connector 630 (and 430) hereinbefore described and illustrated in FIG. 11. Like the FIG. 11 construction it also employs a swing anchor, in this case at 860. Thus it will be seen that the attachment hook 846 of the connector 830 seats on the base of the swing anchor 860 and the swing anchor, in turn, seats on the back paper covered border wire 822 of the wire mesh unit 815.

The connector 830 is constructed so that when mounted as illustrated in FIG. 15 on the back rail 816, the attachment hook 846 is positioned four centimeters (4 cm) above the top of the rail 816. The wire mesh unit 815 is thus normally maintained in horizontal relationship.

There are four (4) to six (6) of these connectors spaced across the back of the wire mesh unit 815 in a chair seat. In a sofa seat more would be employed. The connectors 830 react to load on the wire mesh unit 815 in the manner previously described with relation to the operation of the rail connector 630. The result is to afford initial softness and, subsequently, deep-drop at the back of the wire mesh unit 815 as a subject is seated, with increasing resistance to depression and thus substantial uplift as the subject rises.

The third variation of seat base assembly seen at 910 in FIG. 16 employs a rail connector 930 identical to the rail connector 530 hereinbefore described and illustrated in FIGS. 9 and 10. Thus it will be seen that the attachment hook 946 of the connector 930 seats on the back paper covered border wire 922 of the wire mesh unit 915. The connector 930 is mounted on the back rail 916 of the seat base assembly 910 in a manner which has also been described.

The seat base assembly 910 functions in a manner similar to the seat base assembly 810. It does not employ swing anchors between the attachment hooks 946 and the back paper covered wire 922 of the wire mesh unit 915, however. Accordingly, the initial drop and corresponding softness produced by the use of swing anchors is not present. The elimination of swing anchors reduces the cost of the assembly, however, sacrificing some luxury for a less expensive seat.

Figure 17:
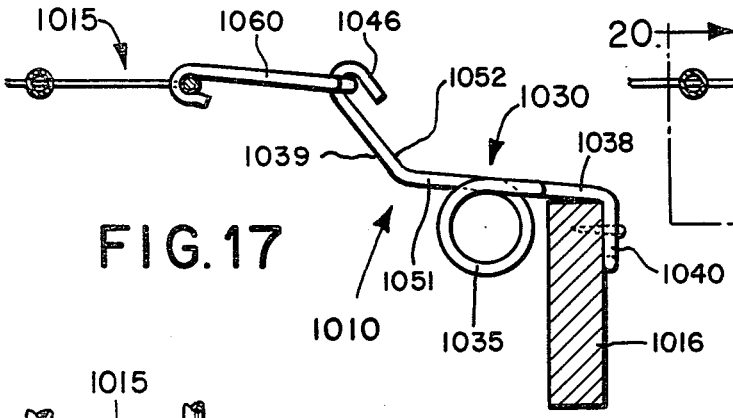
FIG. 17 is a view similar to FIG. 15 illustrating a portion of a fourth variation of the FIG. 13, 14 seat base assembly.
Figure 18:
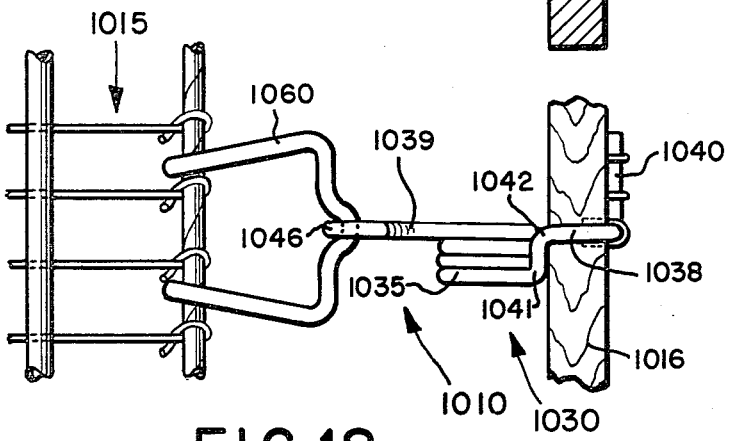
FIG. 18 is a top plan view of the assembly illustrated in FIG. 17.

Turning now to FIGS. 17 and 18, a fourth variation of the second form of seat base assembly embodying features of the invention is illustrated generally at 1010. The seat base assembly 1010 includes a wire mesh unit 1015 identical to those previously discussed. The wire mesh unit 1015 is connected to the front rail (not shown) of the seat base assembly 1010 in a manner also previously discussed.

The back border wire 1022 is connected to the back rail 1016 by a rail connector 1030 and a swing anchor 1060. The swing anchor is a "dimpled" swing anchor such as illustrated in FIGS. 11 and 12 of the aforementioned U.S. Pat. No. 3,790,149.

The rail connector 1030 is fabricated of nine (9) guage wire or heavier, similar to standard sinuous springs. It comprises a section 1035 of four coils tightly wound on an axis parallel to that of the back rail 1016.

Extending from the coil section 1035, at its uppermost extremity, tangent to the arc of the coils and in opposite directions, are a rail attachment leg 1038 and a spring attachment leg 1039. The rail attachment leg 1038 terminates in a depending anchor foot 1040 while the spring attachment leg 1039 seats on the swing anchor 1060.

As seen in FIG. 18, the rail attachment leg 1038 has two right angle bends 1041 and 1042 which bring the leg into longitudinal alignment with the spring attachment leg 1039. The L-shaped anchor foot 1040 depends from the leg 1038 at a point after it has come back into such alignment and is stapled to the back of the rail 1016. The rail attachment leg 1038 is inclined upwardly at an angle of ten degrees (10°) to the top surface of the back rail 1016. The inner segment 1051 of the spring attachment leg 1039 also is inclined upwardly at an angle of ten degrees (10°) to the rail top. The outer segment 1052 of the leg 1039 is inclined upwardly at forty five degrees (45°) to the surface.

An attachment hook 1046 is formed on the free end of the spring attachment leg 1039. The attachment hook 1046 seats on the base leg of the swing anchor 1060 in the dimple 1050 therein.

In operation of the seat base assembly 1010 the back end of the wire mesh unit 1015 moves downwardly as a subject is seated. This downward movement is initially accommodated by downward pivoting of the swing anchor 1060 about its connection to the attachment hook 1046 of the rail connector 1030. What is called initial drop thus takes place without any substantial deflection of the rail connector 1030 itself.

As the weight of the person being seated continues to move the back end of the wire mesh unit 1015 downwardly, the rail connector 1030 begins to be forced downwardly. Because the rail attachment arm 1038 is inclined upwardly at an angle of ten degrees (10°) to the top of the rail 1016, initial downward movement of the rail connector 1030 takes place by bending of the rail attachment leg 1038 until it engages the top of the rail 1016. This distortion of the rail connector 1030 affords resilient resistance to the further downward movement of the back end of the wire mesh unit 1015 but the resistance is not substantial.

Further movement of the wire mesh unit 1015 downwardly underload causes the rail connector 1032 to further distort. This further distortion is opposed by the resilient reaction of the coil spring area 1035 to the downward movement of the spring attachment leg 1039. The outwardly inclined outer segment 1052 of the spring attachment leg 1039 is at such an angle that the force vector effective on the coil 1035 is substantial and produces rapidly increasing resistance to further downward movement at the back end of the wire mesh unit 1015. Substantial upward thrust is thus built into the connector 1030 as downward movement of the wire mesh unit 1015 at its back end occurs, and this lift is translated into uplift under the seated person as he or she rises.

Figure 19:
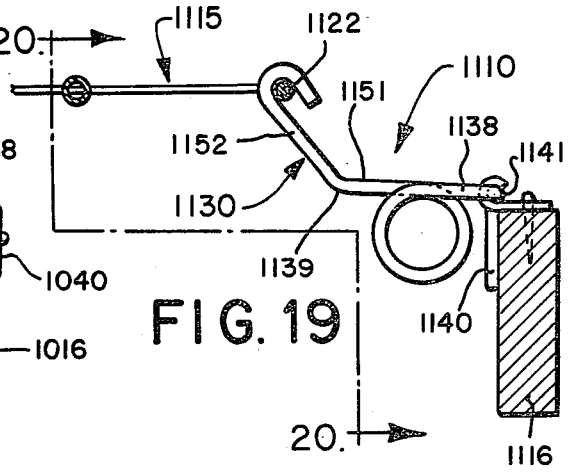
FIG. 19 is a view similar to FIG. 15 illustrating a fifth variation of the FIG. 13, 14 seat base assembly.
Figure 20:
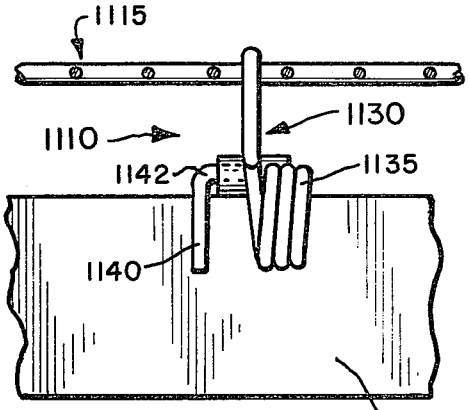
FIG. 20 is a view taken along line 20—20 of FIG. 19.

Turning now to FIGS. 19 and 20, a fifth variation of the second form of seat base assembly embodying features of the invention is illustrated generally at 1110. The seat base assembly 1110 includes a wire mesh unit 1115 identical to those previously discussed. The wire mesh unit 1115 is connected to the front rail (not shown) of the seat base assembly 1110 in a manner indentical to those previously discussed.

The back border wire 1122 is connected to the back rail 1116 by a rail connector 1130. Similar to the rail connector 930 shown in FIG. 16, it does not have a swing anchor connection to the wire mesh unit 1115. Accordingly, the initial drop and corresponding softness produced by the use of swing anchor is not present. Again, the elimination of swing anchors reduces the cost of the assembly, sacrificing some luxury for a less expensive seat.

The rail connector 1130 is, like the rail connector 1030, fabricated of nine (9) guage wire or heavier, similar to standard sinuous springs. It comprises a section 1135 of three coils tightly wound on an axis parallel to the back rail 1116.

Extending from the coil section 1135, at its uppermost extremity, tangent to the arc of the coils and in opposite directions, are a rail attachment leg 1138 and a spring attachment 1139. The rail attachment leg 1138 terminates in a depending anchor foot 1140 while the spring attachment leg 1139 seats on the back paper covered border wire 1122 of the wire mesh unit 1115.

The rail attachment leg 1138 has a right angle bend 1141 which brings the leg into alignment with the back rail 1116 to a point opposite the spring attachment leg 1139 from the coils 1135, where it bends downwardly in another right angle bend 1142 to become a bracing foot 1140. The leg 1138 between the bends 1141 and 1142 is seated in a conventional HDS clip mounted on top of the rail 1116, as illustrated. The foot 1140 braces against the rail 1116.

The spring attachment leg 1139 includes an inner-segment 1151 and an outer-segment 1152. The outer-segment 1152 is bent upwardly at an angle of forty five degrees (45°) to the inner-segment 1151. An attachment hook 1146 is formed on the free end of the spring attachment leg 1139. The attachment hook 1146 seats on the paper covered wire 1122.

In operation, the connector 1130 performs in substantially the same manner as the rail connector 1030 hereinbefore discussed. Unlike the rail connector 1030, however, it is mounted on the inside of the rail 1116 so that all resistance to downward movement of the back end of the wire mesh unit 1115 is afforded by the connector itself. The result is that the connector 1130 affords a softer seat than the rail connector 1030, although it does not provide the initial drop afforded by the swing anchor connection which is incorporated in the seat base assembly 1010.

Referring now to FIG. 24, a sixth variation of the second form of seat base assembly embodying features of the invention is illustrated generally at 1210. The seat base assembly 1210 includes a wire mesh unit 1215 identical to those previously discussed and connected to the front rail in a similar manner.

The back border wire 1222 of the wire mesh unit 1215 is connected to the back rail 1216 by a rail connector 1230. The rail connector 1230 is fabricated of nine (9) guage wire or heavier, again similar to standard sinuous springs. It comprises a section 1235 of three coils tightly wound on an axis longitudinal to the seat base assembly 1210; i.e., parallel to the side rails of the seat base assembly.

In all other respects, the rail connector 1230 is identical to the rail connector 1030 hereinbefore discussed. It contains corresponding components and is mounted in an identical fashion. Accordingly, corresponding reference numerals plus two hundred digits are used for corresponding components.

The operation is of the rail connector 1230 is substantially identical to that of the rail connector 1030 except for the reaction of the coil section 1235. This type of a coil section gives less resistance to downward movement than the coil section 1035 hereinbefore discussed with relation to the rail connector 1030 and, accordingly, a softer seat is afforded by the rail connector 1230.

Figure 25:
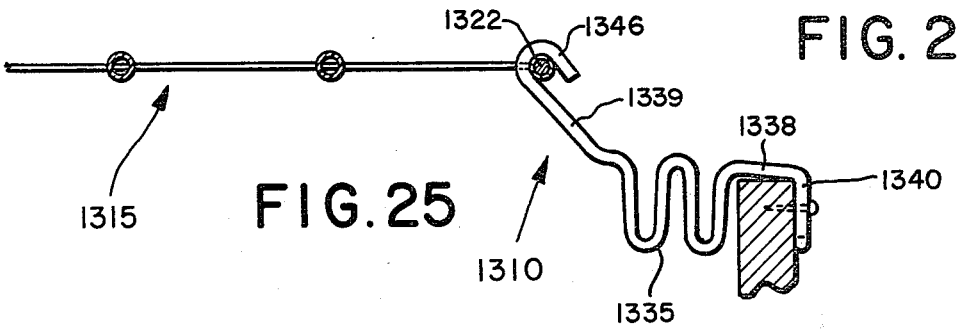
FIG. 25 is a view similar to FIG. 15 illustrating a seventh variation of the FIG. 13, 14 seat base assembly.

Looking now at FIG. 25, a seventh variation of the second form of seat base assembly embodying features of the invention is illustrated generally at 1310. Again, the seat base assembly 1310 includes a wire mesh unit 1315 identical to those previously discussed and connected to the front rail in a similar manner.

The back border wire 1322 is connected to the back rail 1316 by a rail connector 1330. The rail connector 1330 is fabricated of a nine (9) guage or heavier wire, similar to standard sinuous springs. It includes a "W" section 1335 which provides an amount of resilience less than a coil section but more than a straight section of wire.

Extending from the inner leg of the W section 1335 is a rail attachment leg 1338 and from the outer other leg extends a spring attachment leg 1339. The rail attachment leg 1338 terminates in a depending anchor foot 1340 while the spring attachment 1339 is inclined upwardly at an angle of thirty five degrees (35°) toward the paper covered back border wire 1322 of the wire mesh unit 1315. An attachment hook 1346 is formed on the free end of the spring attachment leg 1339 and seats on the border wire 1322.

Turning now to FIGS. 21–23, a second form-eighth variation of seat base assembly embodying features of the invention is illustrated generally at 1410. The seat base assembly 1410 comprises cushion base means in the form of a wire mesh unit 1415 mounted between the back rail 1416 and the front rail 1417 of an automobile seat frame. The rails 1416 and 1417 are connected by two side rails 1418. All of the rails are fabricated of steel channel members and are joined together by welding in a conventional manner.

As best illustrated in FIGS. 21 and 22, the side rails 1418 are upright while the front rail 1417 and the back rail 1416 are inclined outwardly. The back rail 1416 is inclined outwardly from the vertical at an angle of approximately thirty five (35°) degrees. The front rail 1417 is, in turn, inclined outwardly from the vertical at an angle of approximately thirty (30°) degrees. The front rail 1417 is substantially wider than the back rail 1416 and, accordingly, extends approximately four centimeters (4 cm) above the level of the top of the back rail 1416 (and the side rails 1418).

The wire mesh unit 1415 is identical to that described in the seat base assembly 710. Accordingly, where illustrated, corresponding components bear corresponding reference numerals with the exception that reference numerals in the fourteen hundred series rather than the seven hundred series are used.

At the front rail 1417 the wire mesh 1415 is pivotally connected to the rail on the axis of the front border wire 1421 by anchor hooks 1428 formed out of the rail 1417 adjacent the top of the rail. The front border wire 1421 seats in the hooks 1428 so that its pivot axis is at the top of the front rail 1417 on its inner surface, as best seen in FIG. 22.

The longitudinal dimension of the wire unit 1415, between the front border wire 1421 and the back border wire 1422, is again such that it extends approximately ninety percent (90%) of the distance between the front rail 1417 and the back rail 1416. The back end of the wire mesh unit 1415 is connected to the back rail 1416 of the seat frame by series of four (4) to six (6) rail connectors 1430 which are similar to the rail connectors 1030 and 1130 illustrated in FIGS. 17–18, and FIGS. 19–20, respectively. They differ only in the manner that their rail attachment legs 1438 are constructed to facilitate attachment to the back rail 1416 of the frame.

Once again the rail connectors 1430 are fabricated of a nine (9) guage wire, or heavier, similar to standard sinuous springs. Each connector comprises a section 1435 of four (4) coils tightly wound on an axis parallel to that of the back rail 1416.

Extending from the coil section 1435, at its uppermost extremity, tangent to the arc of the coils and in opposite directions, are a rail attachment leg 1438 and a spring attachment leg 1439. The rail attachment leg 1438 terminates in a depending anchor foot 1440 while the spring attachment leg seats on the back border wire 1422 of the wire mesh unit 1415.

The spring attachment leg 1439 includes an inner segment 1451 and an outer segment 1452. The outer segment 1452 is bent upwardly at an angle of forty-five degrees (45°) to the inner segment 1451. An attachment hook 1446 is formed on the free end of the spring attachment leg 1439 and seats on the paper covered border wire 1422.

As seen in FIG. 21, the rail attachment leg 1438 has two right angle bends 1441 and 1442 which bring the leg into longitudinal alignment with the spring attachment leg 1439. An a irregularly shaped anchor foot 1440 depends from the leg 1438 at its back end and is inclined downwardly and inwardly at an angle corresponding to the angle of inclination of the back rail 1416. The foot 1140 extends through an anchor hook 1455 formed inwardly out of the back rail 1416 by conventional means. The bottom end of the foot 1440 is offset transversely of the leg 1438, as at 1460, whereby when braced against the back rail it prevents the connector 1430 from cocking out parallel alignment the side rails.

In operation, the connector 1430 performs in substantially the same manner as the rail connectors 1030 and 1130 hereinbefore discussed. Like the rail connector 1130, the rail connector 1430 is mounted on the inside of the rail 1416 so that all resistance to downward movement of the back end of the wire mesh unit 1415 is afforded by the connector itself.

Figure 26:
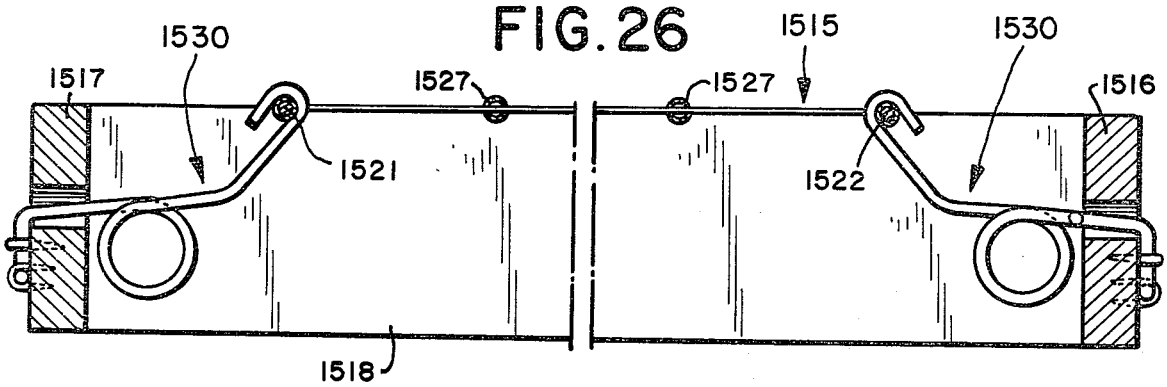
FIG. 26 is a vertical sectional view through a seat base assembly embodying features of a ninth variation of the FIG. 13, 14 seat base assembly.
Figure 27:
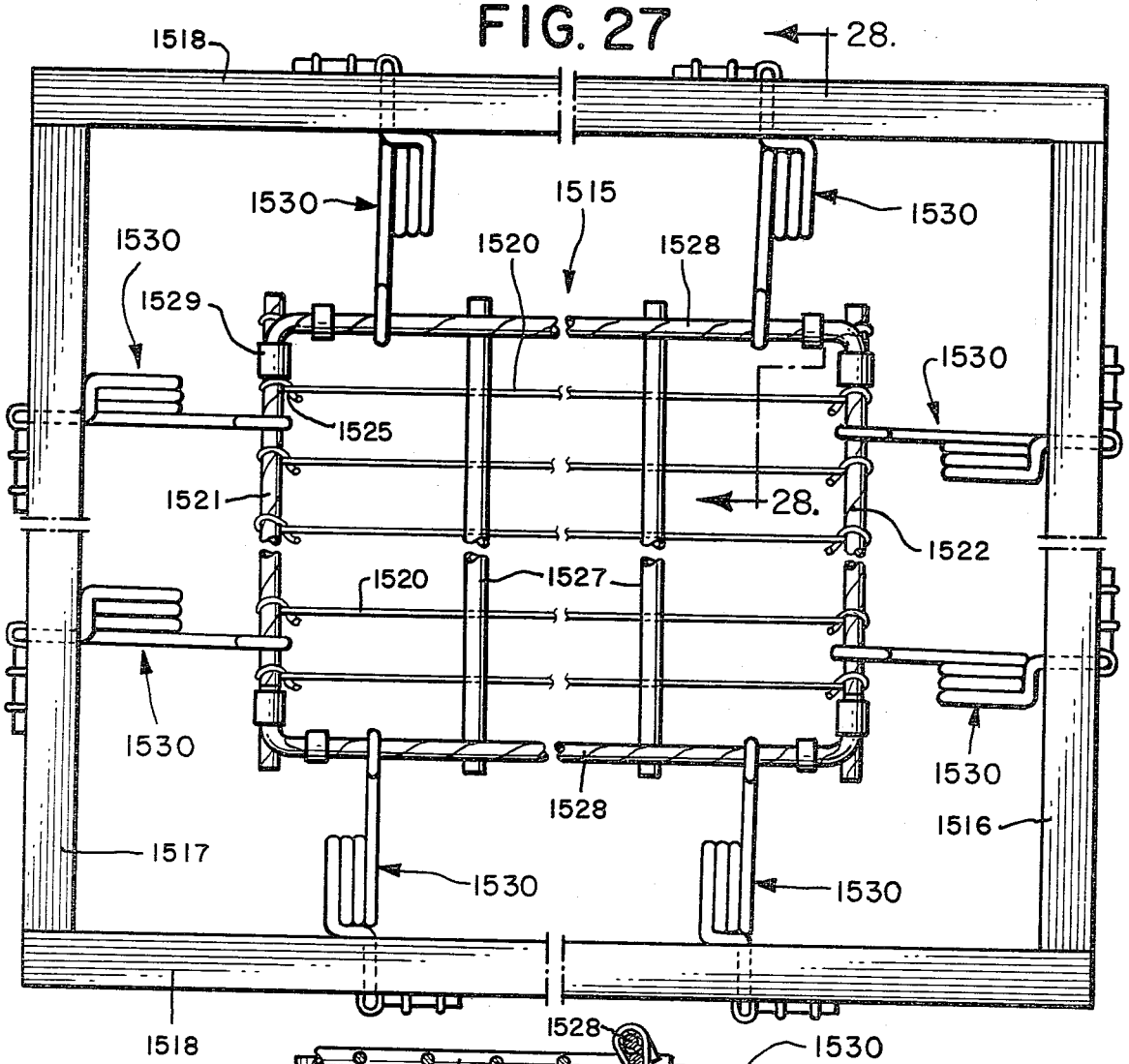
FIG. 27 is a top plan view of the seat base assembly illustrated in FIG. 26.
Figure 28:
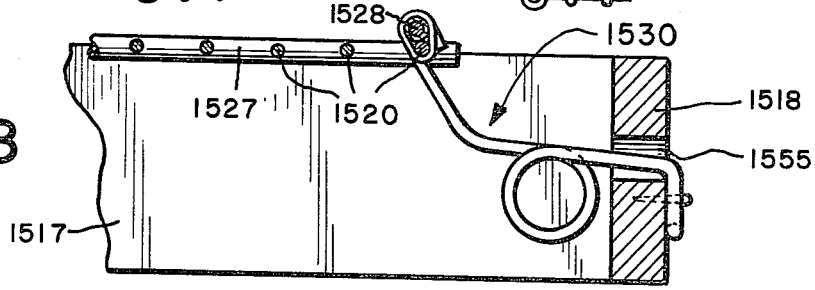
FIG. 28 is a view taken along line 28—28 of FIG. 27.

FIGS. 26–28 illustrate a second form-ninth variation of seat base assembly embodying features of the invention, generally at 1510. The seat base assembly 1510 is designed and constructed for a modulator or "pit-group" furniture piece. As such, it will subsequently be seen that the seat base assembly 1510 has no front, back, or sides, but may used with the seated subject facing in any direction. In this regard, the seat base assembly 1510 is designed and constructed to provide a uniform seat regardless of which direction the seated subject faces.

The seat base assembly 1510 includes what will nominally be termed a back rail 1516, a front rail 1517, and side rails 1518, all fabricated of wood in a conventional manner. Mounted within the confines of the rails 1516–1518 is a wire mesh unit 1515 substantially identical to those hereinbefore discussed with relation to other variations of the second form of the invention.

As best seen in FIGS. 26 and 27, the wire mesh unit 1515 includes steel wires 1520 extending parallel to each other and to the side rails 1518 between a front border wire 1521 and a back border wire 1522. The wires 1520 are secured to corresponding border wires 1521 and 1522 by being wrapped around the border wires and back upon themselves, as at 1525. Spacer tubes 1527 are provided in the unit 1515 in a manner hereinbefore discussed with relation to the unit 715.

Unlike previously described wire mesh units, however, the wire mesh unit 1515 has paper wrapped side border wires 1528, also. The side border wires 1528 extend along the side extremities of the wire mesh unit 1515 approximately at the ends of the spacer tubes 1527, and are clamped to corresponding ends of the front border wire 1521 and back border wire 1522 by identical wire clamps 1529.

The wire mesh unit 1515 is connected to the rails 1516–1518 by rail connectors 1530 substantially identical to the rail connectors 1030 hereinbefore discussed. Four (4) to six (6) connectors 1530 are spaced along each of the four rails.

Each connector 1530 has an attachment leg 1538 extending through a bore 1555 drilled through a corresponding rail at a point four centimeters (4 cm) below the rail top. An anchor foot 1540 on the leg 1538 seats against the outer surface of the rail and is stapled thereto.

The connector 1530 has a spring attachment leg 1539 extending upwardly to an attachment hook 1546 which seats on a corresponding border wire (1521, 1522, or 152) of the wire mesh unit 1515. The wire mesh unit 1515 is supported in normal relationship at the level of the top of the rails 1516–1518.

As illustrated in FIG. 27, the rail attachment leg 1538 is normally inclined upwardly at a slight angle, preferably ten degrees (10°) to the bottom of the bore 1555 through which it passes. In this regard the connector 1530 is also mounted like the aforedescribed connector 1030. As a result the effect the connectors 1530 produce on the seat base assembly 1510 is substantially identical to that previously discussed in relation to the connector 1030.

Figure 29:
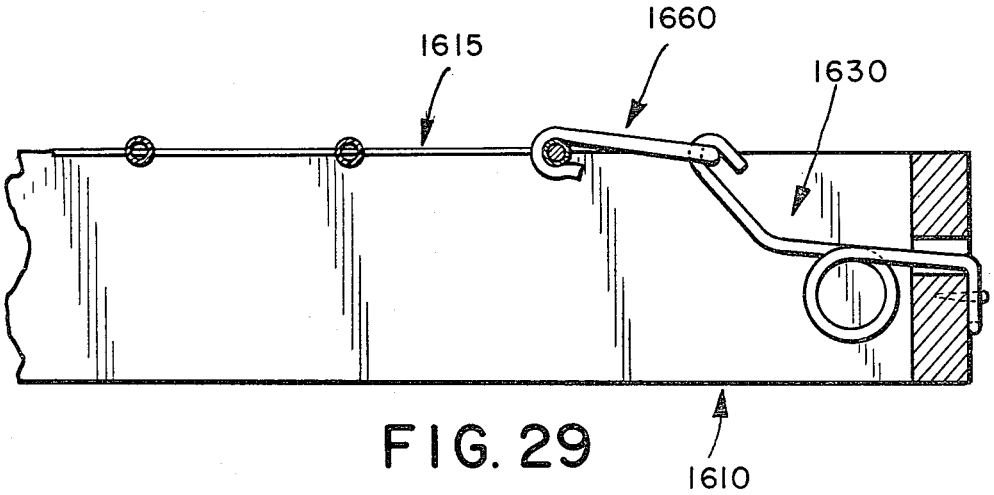
FIG. 29 is a view, similar to FIG. 26 but with parts removed, showing an tenth variation of the FIG. 13, 14 seat base assembly.

Referring finally to FIG. 29, a tenth variation of the second form of seat base assembly embodying features of the invention is seen generally at 1610. The assembly 1610 is identical to the assembly 1510 discussed immediately above except that dimpled swing anchors 1660 are disposed between the rail connectors 1630 and the border wires of the wire mesh unit 1615. The effect of using swing anchors has previously been discussed.

I claim:

1. In a seat base assembly including a frame having a front rail and a back rail and a seat base support means disposed between said rails, the improvement in a seat base support assembly, comprising:

(a) a seat base member connected to the front rail and extending into close proximity with the back rail;

(b) a rail connector connecting said member to the back rail;

(c) said rail connector having non-coil spring means for storing energy and having a rail attachment leg at one end thereof and a spring attachment leg at the other end thereof;

(d) said spring means being effective to resiliently oppose downward movement of said spring attachment leg relative to said rail attachment leg;

(e) said spring attachment leg being connected to said member;

(f) said rail attachment leg including a generally vertically arranged portion engaging one of the inside or outside surfaces of said back rail relative to said seat frame;

(g) said spring attachment leg extending upwardly from said rail attachment leg so as to connect to said member at a point substantially above said rail attachment leg.

2. The improvement in a seat base support assembly of claim 1 further characterized in that:

(a) said connector comprises a resilient strip mounted on said rail and cantilvered therefrom inwardly of said rail relative to said seat frame;

(b) said strip extending upwardly from said rail and terminating in an attachment hook which is connected to said seat base member.

3. The improvement in a seat base support assembly of claim 2 further characterized in that:

(a) said strip includes said rail attachment leg and said spring attachment leg;

(b) said spring attachment leg being divided into a plurality of angularly displaced segments including an outer segment immediately adjacent to the rail attachment leg, an intermediate segment inclined inwardly and upwardly from said outer segment, and an inner segment inclined inwardly and upwardly from said intermediate segment.

4. The improvement in a seat base support assembly of claim 3 further characterized in that:

(a) said outer segment is inclined upwardly at an angle of approximately 10° to the horizontal;

(b) said intermediate segment is inclined upwardly at an angle of approximately 15° from said outer segment; and (c) said inner segment is inclined upwardly at an angle of approximately 35° from said intermediate segment or approximately 60° from the horizontal.

5. The improvement in a seat base support assembly of claim 2 further characterized by and including:

(a) generally horizontally arranged link means between said attachment hook and said cushion base member;

(b) said link means being pivotally connected to said cushion base member and adapted to pivot relative thereto to permit initial drop of said cushion base member under load without substantial vertical distortion of said connector.

6. The improvement in a seat base support assembly of claim 2 further characterized in that:

(a) said strip includes said rail attachment leg and said spring attachment leg;

(b) said spring attachment leg extending inwardly and upwardly in an arc from said rail attachment leg to said attachment hook.

7. The improvement in a seat base support assembly of claim 1 further characterized in that:

(a) said connector comprises hardened spring wire mounted on said rail and cantilevered therefrom inwardly of said rail relative to said seat frame;

(b) said rail attachment leg being braced against the inside of said rail relative to said seat frame;

(c) said spring attachment leg extending upwardly and inwardly from the lower end of said rail attachment leg.

8. The improvement in a seat base support assembly of claim 7 further characterized by and including:

(a) generally horizontally arranged link means between said attachment leg and said cushion base member;

(b) said link means being pivotally connected to said cushion base member and adapted to pivot relative thereto to permit initial drop of said cushion base member under load without substantial vertical distortion of said connector.

* * * * *